US006899648B2

(12) United States Patent
Chang

(10) Patent No.: US 6,899,648 B2
(45) Date of Patent: May 31, 2005

(54) WOOD BAT INTERNALLY AND EXTERNALLY REINFORCED WITH COMPOSITE MATERIAL OR METAL

(76) Inventor: Jung-Shih Chang, No. 32, Lane 25, Li Min Street, Ta Li City, Taichung Hsien (TW)

( * ) Notice: Subject to any disclaimer, the term of this patent is extended or adjusted under 35 U.S.C. 154(b) by 0 days.

(21) Appl. No.: 10/704,820

(22) Filed: Nov. 12, 2003

(65) Prior Publication Data

US 2005/0070383 A1 Mar. 31, 2005

(30) Foreign Application Priority Data

Sep. 26, 2003 (CN) ..... 03160122 A

(51) Int. Cl.[7] ..... A63B 59/06
(52) U.S. Cl. ..... 473/564; 473/566; 473/567
(58) Field of Search ..... 473/564–568, 473/519, 520, 457

(56) References Cited

U.S. PATENT DOCUMENTS 377,686 A * 2/1888 Moose ..... 473/564
727,359 A * 5/1903 Held ..... 473/564
795,815 A * 8/1905 Burrows ..... 473/564
1,063,563 A * 6/1913 May ..... 473/564
1,665,195 A * 4/1928 Cohn ..... 473/520
2,195,681 A * 4/1940 Robarge ..... 473/564
2,379,006 A * 6/1945 Johnson ..... 473/568
3,377,066 A * 4/1968 Trowbridge ..... 473/564
3,877,698 A * 4/1975 Volpe ..... 473/520
4,572,508 A * 2/1986 You ..... 473/520
4,714,251 A * 12/1987 Cook ..... 473/564
4,844,460 A * 7/1989 Mitchell et al. ..... 473/564
5,165,686 A * 11/1992 Morgan ..... 473/564
5,277,421 A * 1/1994 Rewolinski ..... 473/457
5,676,609 A * 10/1997 Mollebaek ..... 473/564
6,113,508 A * 9/2000 Locarno et al. ..... 473/516
6,139,451 A * 10/2000 Hillerich et al. ..... 473/564
6,692,386 B2 * 2/2004 Brundage ..... 473/457
2004/0029660 A1 * 2/2004 Chen et al. ..... 473/564

* cited by examiner

*Primary Examiner*—Mark S. Graham
(74) *Attorney, Agent, or Firm*—Browdy and Neimark, P.L.L.C.

(57) ABSTRACT

An improved wood bat for baseball includes a wood body having a handle portion, a barrel portion, and a tapered portion therebetween. An axial hole is disposed longitudinally along the axis of the wood body from one end of the handle and extending a predetermined distance. A tubular core made of fiber reinforced plastic materials or metal is fitted to be received in the axial hole to internally reinforce the wood body. The wood bat may further comprise an outer sleeve which is made of fiber reinforced plastic materials or metal and surrounds the barrel to get an external reinforcing.

11 Claims, 3 Drawing Sheets

WOOD BAT INTERNALLY AND EXTERNALLY REINFORCED WITH COMPOSITE MATERIAL OR METAL

BACKGROUND OF THE INVENTION

1. Field of the Invention

The present invention relates to bats for baseball and, more particularly, to a wood bat which is internally reinforced with a tubular core made of fiber reinforced plastic materials or metal and externally reinforced with an outer sleeve made of fiber reinforced plastic materials or metal.

2. Description of the Related Art

Wooden bats are most popularly used because they are the cheapest ones. However, wooden bats have numerous drawbacks, such as heavy weight and bad equilibrium. In other words, the center of gravity is biased to the side of the barrel end. The center of gravity of a wooden bat is at about 11 inches from the barrel end, however the ideal center of gravity should be at the area within 14~14.5 inches from the barrel end. Due to the aforesaid drawbacks, it requires much effort to hit the ball with the bat, and the bat cannot drive the ball to a long distance. Further, a wooden bat is weak and easy to break, and produces severe shocks when hitting the ball.

In comparison to wooden bats, an aluminum bat is relatively lighter in weight, and has an ideal equilibrium. Therefore, the performance of an aluminum bat is superior to conventional wooden bats, and an aluminum bat is more durable than conventional wooden bats. Further, the price of aluminum bats is reasonable. However, an aluminum bat produces shocks, noises and dents at barrel when hitting the ball.

The recently developed bats made of fiber reinforced plastic (FRP) material have the ideal counterweight and equilibrium and high performance in hitting. Further, a FRP bat has a strong structural strength, and does not break easily. However, The problem is that the FRP bat is so expensive that it can not get a popular use.

SUMMARY OF THE INVENTION

It is one object of the present invention to provide a wood bat internally and externally reinforced and having a light weight, good equilibrium, and high structural strength for a good performance.

It is another object of the present invention to provide a reinforced wood bat, which produces less shock when hitting the ball.

It is still another object of the present invention to provide a reinforced wood bat, which has its center of gravity adjustable.

It is still another object of the present invention to provide a wood bat, which has the surface well protected against damage.

To achieve these and other objects of the present invention, the wood bat comprises a wood body having a handle portion, a barrel portion, and a tapered portion therebetween. An axial hole is disposed longitudinally along the axis of the wood body from one end of the handle and extending a predetermined distance. A tubular core made of fiber reinforced plastic materials or metal is fitted to be received in the axial hole. The wood bat may further comprise an outer sleeve which is made of fiber reinforced plastic materials or metal and surrounds the barrel to get an external reinforcing. In addition, the wood bat according to the present invention may have at least one shock-absorbing member installed in the tubular core to lessen shocks when hitting the ball or one weighting member installed in the tubular core to adjust the center of gravity of the bat.

BRIEF DESCRIPTION OF THE DRAWINGS

These and other objects of the invention will become more clear upon a through study of the following description of the best mode for carrying out the invention, particularly when reviewed in conjunction with the drawings, wherein.

DETAILED DESCRIPTION OF THE INVENTION

Figure 1:
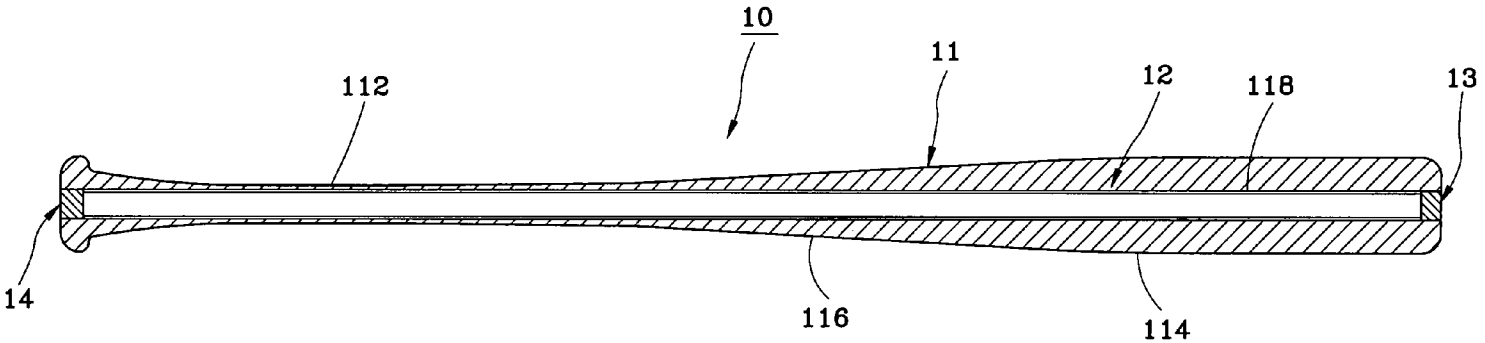
FIG. 1 is a longitudinal sectional view of a wood bat constructed according to the first embodiment of the present invention.

With reference first to FIG. 1, a combination bat, referenced by 10, in accordance with the first embodiment of the present invention is shown comprising a wood body 11, a tubular core 12, a front plug 13, and a rear plug 14.

The wood body 11 having the shape of a conventional bat for baseball includes a handle 112, a barrel 114, and a tapered portion 116 therebetween. The body 11 has an axial hole 118 which is disposed longitudinally along the axis of the wood body 11 from one end of the handle 112, extending into the tapered portion 114, and terminating at one end of the barrel 114.

The tubular core 12 is a tubular member made of fiber reinforced plastic materials or metal, for example, carbon fiber reinforced epoxy resin, or aluminum alloy. The outer diameter of the core 12 is fitted the diameter of the axial hole 118 to be tightly received therein. The front plug 13 is plugged in the top end of the axial hole 118. The rear plug 14 plugged in the bottom end of the axial hole 118.

Figure 2:
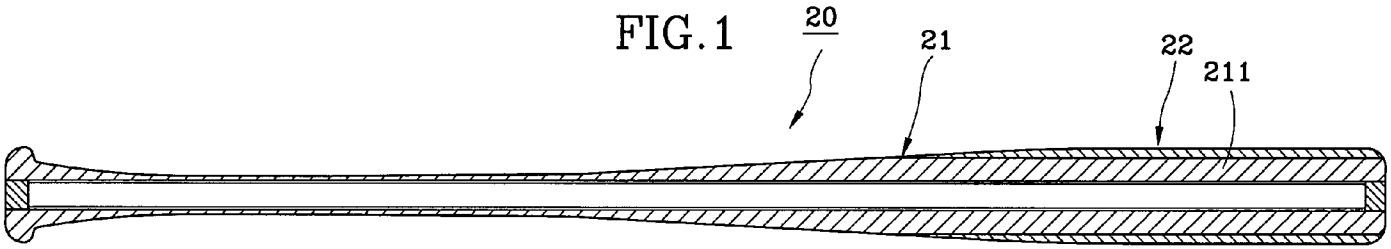
FIG. 2 is a longitudinal sectional view of a wood bat constructed according to the second embodiment of the present invention.

In production, the bat can be variously embodied. FIG. 2 shows a wood bat 20 constructed according to the second embodiment of the present invention. According to this embodiment, the bat 20 is similar to the bat 10 of the first embodiment. The difference is that the bat 20 further includes an outer sleeve 22 made of fiber reinforced plastic materials or metal, for example, carbon fiber reinforced epoxy resin, or aluminum alloy. The outer sleeve 22 surrounds the barrel 211 of the wood body 21. Whereby, the wood body 21 can get an external reinforcing provided by the outer sleeve 22.

Figure 3:
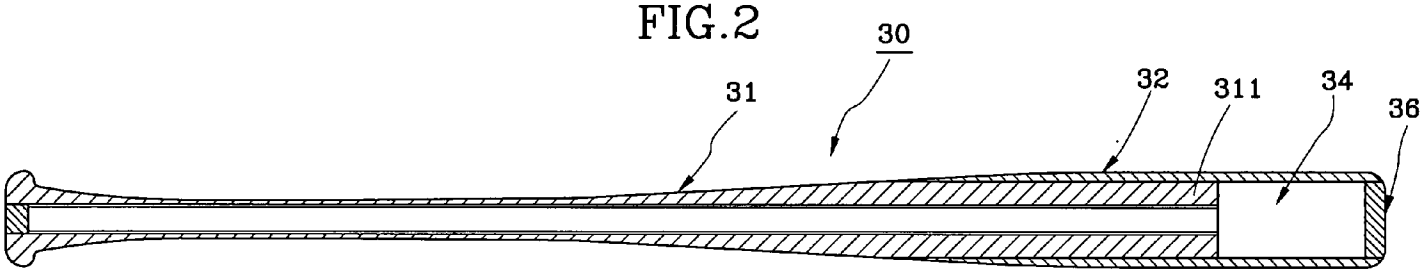
FIG. 3 is a longitudinal sectional view of a wood bat constructed according to the third embodiment of the present invention.

FIG. 3 shows a wood bat 30 constructed according to the third embodiment of the present invention. According to this embodiment, the bat 30 also has an outer sleeve 32 as the bat 20 of the second embodiment. But the outer sleeve 32 has a front end extending from the open end of the barrel 311 of the wood body 31 a predetermined length to form a circular room 34 having an open end. A front end cap 36 is attached to the open end of the room 34. For not effecting the normal length of the bat 30, the length of the barrel 311 is reduced. A shock-absorbing filler (not shown in the drawings) can be filled in the room 34.

Figure 4:
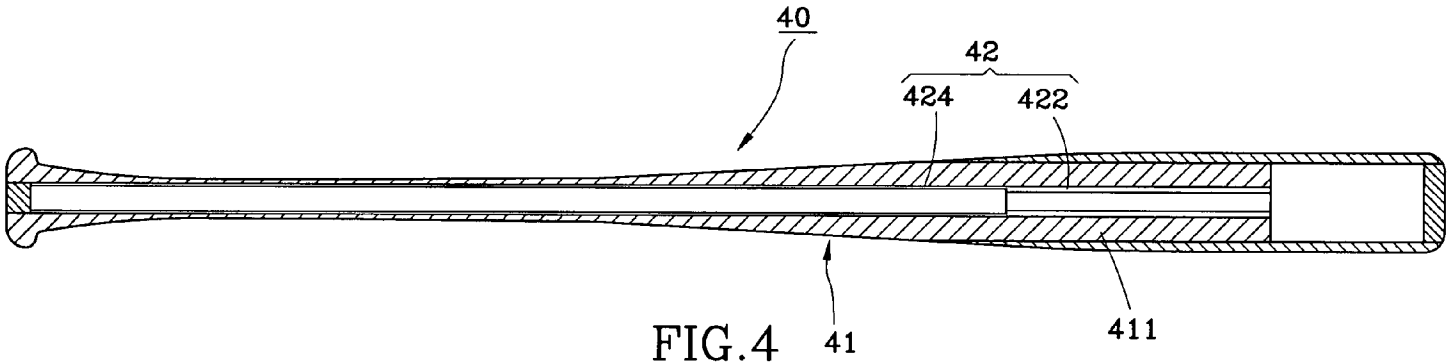
FIG. 4 is a longitudinal sectional view of a wood bat constructed according to the fourth embodiment of the present invention.

FIG. 4 shows a wood bat 40 constructed according to the fourth embodiment of the present invention. According to this embodiment, the tubular core 42 includes a strengthened portion 422 having a first wall thickness and a regular portion 424 having a second wall thickness that is thinner than the first wall thickness of said strengthened portion 422. The strengthened portion 422 is arranged to correspond to the barrel 411 of the wood body 41.

Figure 5:
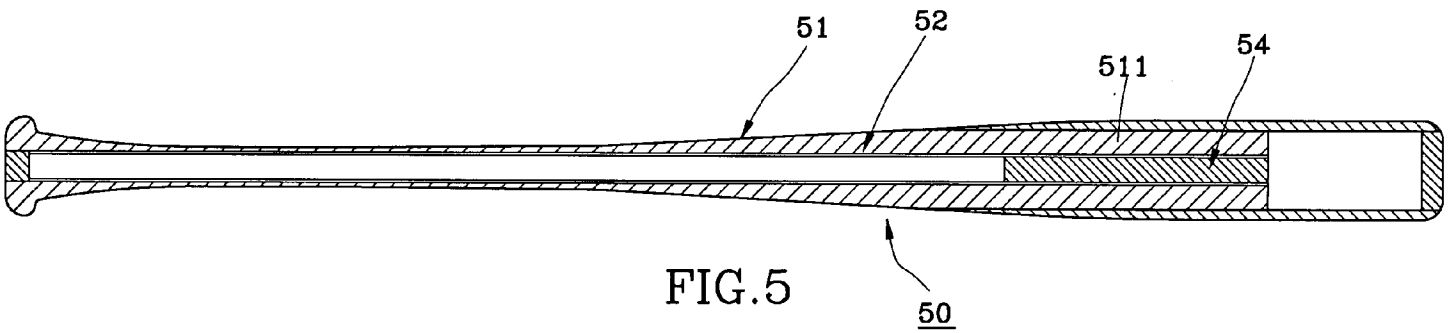
FIG. 5 is a longitudinal sectional view of a wood bat constructed according to the fifth embodiment of the present invention.

FIG. 5 shows a wood bat 50 constructed according to the fifth embodiment of the present invention. According to this embodiment, the tubular core 52 of the bat 50 has a front portion corresponding to the barrel 511 of the wood body 51. A reinforcing member 54 is fitted to insert into the front portion of the tubular core 52.

Figure 6:
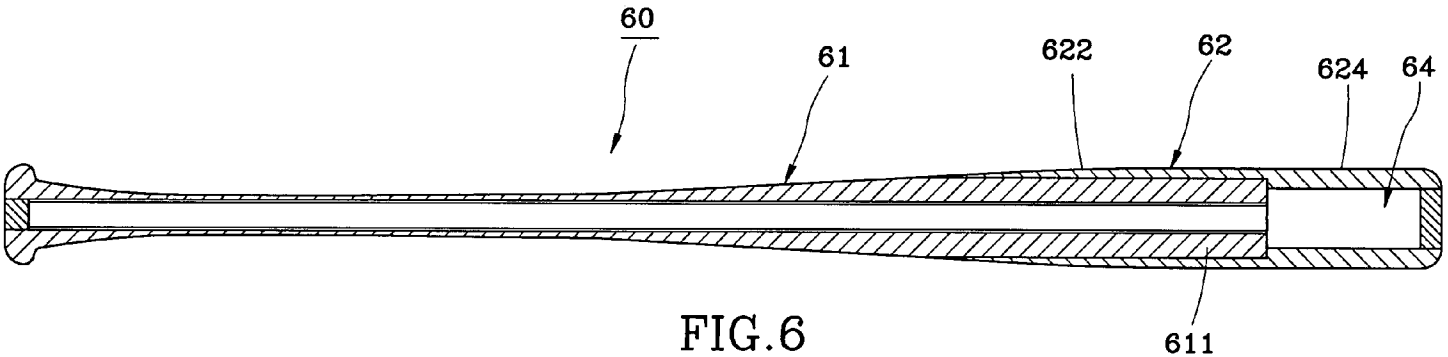
FIG. 6 is a longitudinal sectional view of a wood bat constructed according to the sixth embodiment of the present invention.

FIG. 6 shows a wood bat 60 constructed according to the sixth embodiment of the present invention. According to this embodiment, the bat 60 is similar to the bat 30 of the third embodiment. The difference between them is that the outer sleeve 62 of the bat 60 includes a rear portion 622 and a front portion 624 extending from one end of the rear portion 622. The front portion 624 has a first wall thickness and goes beyond the open end of the barrel 611 a predetermined length to form a circular room 64. The rear portion 622 surrounds the barrel 611 and has a second wall thickness that is thinner than the first wall thickness of the front portion 624.

Figure 7:
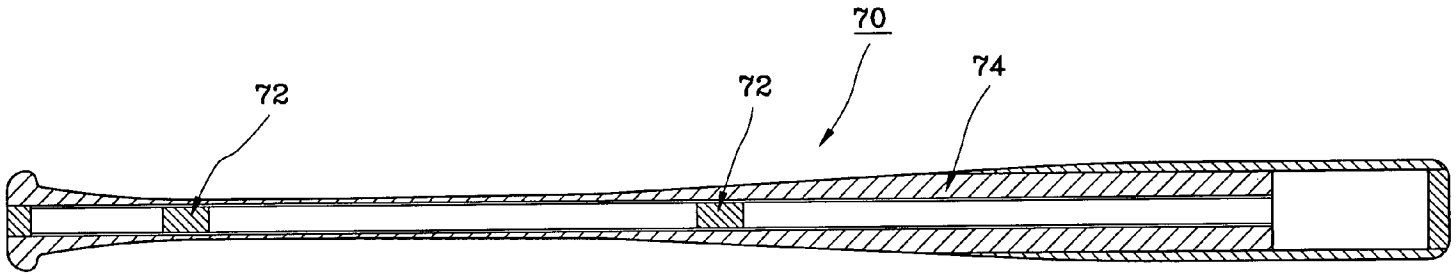
FIG. 7 is a longitudinal sectional view of a wood bat constructed according to the seventh embodiment of the present invention.

FIG. 7 shows a wood bat 70 constructed according to the seventh embodiment of the present invention. According to this embodiment, the bat 70 includes two shock-absorbing members 72 which are cylindrical members respectively made of shock-absorbing materials such as foamed plastic, cloth or cork and tightly inserted into the inside of the tubular core 74 at selected locations. The shock-absorbing members 72 can be made having a certain weight for adjusting the center of gravity of the bat 70.

Figure 8:
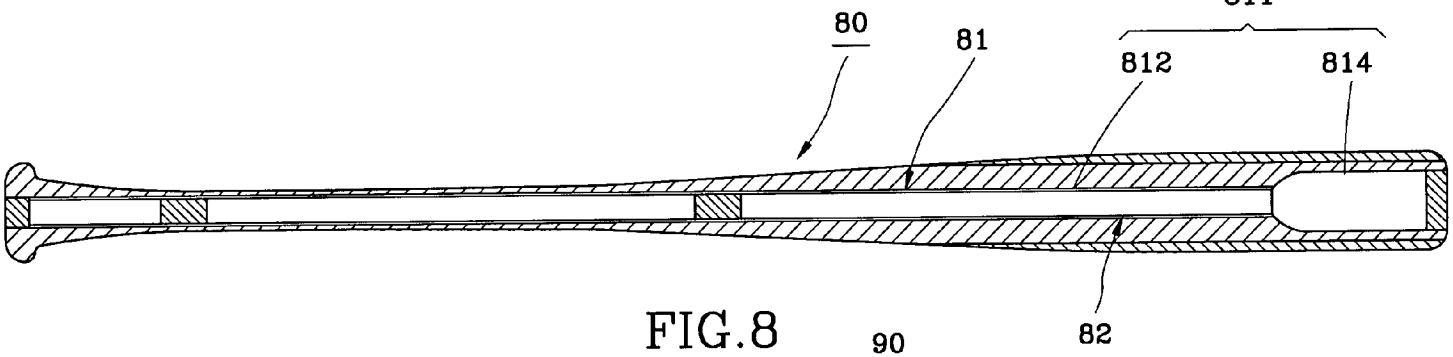
FIG. 8 is a longitudinal sectional view of a wood bat constructed according to the ninth embodiment of the present invention.

FIG. 8 shows a wood bat 80 constructed according to the eighth embodiment of the present invention. According to this embodiment, there has a difference between the axial hole 811 of the wood body 81 and the axial hole 211 of the wood body 21 that the former includes a rear section 812 having a first diameter and a front section 814 having a second diameter that is larger than the first diameter of the rear section 812. The tubular core 82 is fitted to insert in the inside of the rear section 812.

Figure 9:
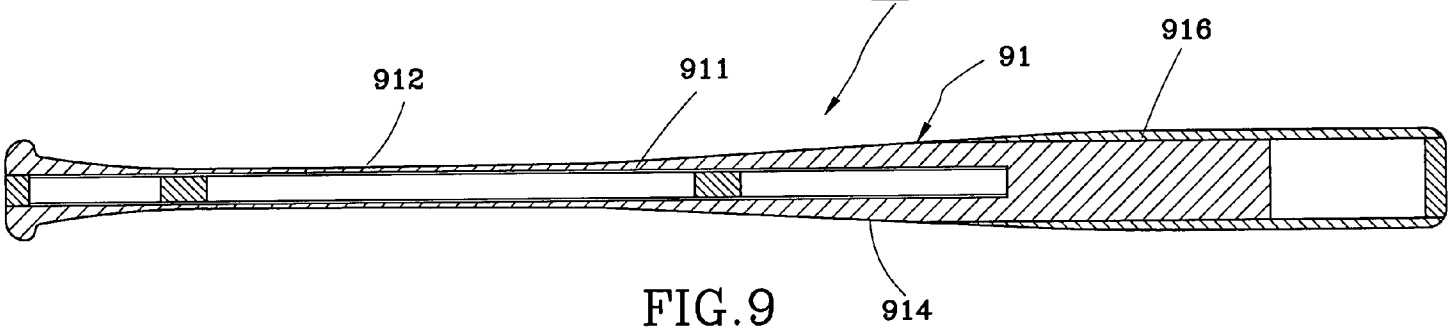
FIG. 9 is a longitudinal sectional view of a wood bat constructed according to the tenth embodiment of the present invention.

FIG. 9 shows a wood bat 90 constructed according to the ninth embodiment of the present invention. According to this embodiment, the bat 90 is similar to the bat 30 of the third embodiment. The only difference between them is that the wood body 91 of the bat 90 has an axial hole 911 disposed from the handle 912 and extending into the tapered portion 914 but terminating short of the barrel 916. In other words, the barrel 916 is not hollow.

The wood bats mentioned above have numerous advantages as follows:

1. Because the wood body has a hollow portion and is reinforced by the tubular core and the outer sleeve having a relatively lower specific gravity than wood materials, the bat would not be broken or deformed easily and the total weight thereof is relatively lighter than conventional wooden bats.

2. The center of gravity of the bat can be positioned within the area between 14~14.5 inches distanced from the barrel end thereof.

3. The shock-absorbing members in the wood body can absorb shocks upon hitting a pitched ball, preventing sport injury to the user.

4. The reinforced wood bat does not cause noises like an aluminum bat when hitting the ball.

5. The reinforced wood bat has all advantages of a FRP bat but has a lower manufacturing cost comparing with that of a FRP bat.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A bat, comprising:

an elongated wood body including a handle, a barrel, a tapered portion therebetween, and an axial hole disposed longitudinally along the axis of said wood body from said handle and extending a predetermined distance;

a tubular core made of fiber reinforced plastic materials or metal and received in said axial hole; and an outer sleeve made of fiber reinforced plastic materials or metal and tightly surrounding said barrel;

wherein said outer sleeve includes a rear portion and a front portion extending from one end of said rear portion, said front portion having a first wall thickness which goes beyond an open end of said barrel a predetermined length to form a room having an open end, said rear portion surrounding said barrel has a second wall thickness that is thinner than the first wall thickness of said front portion, a front end cap is attached to the open end of said room.

2. The bat of claim 1, further comprising at least one shock-absorbing member respectively inserted inside said tubular core.

3. The bat of claim 1, further comprising at least one weight respectively inserted inside said tubular core.

4. The bat of claim 1, wherein said tubular core includes a strengthened portion having a first wall thickness and a regular portion having a second wall thickness that is thinner than the first wall thickness of said strengthened portion, said strengthened portion is arranged to correspond to said barrel.

5. The bat of claim 1, wherein said tubular core has a front portion corresponding with said barrel and a first reinforcing member tightly inserted therein.

6. The bat of claim 5, further comprising a second reinforcing member received in said room.

7. The bat of claim 1, wherein said tubular core has a front portion corresponding with said barrel and a reinforcing member tightly inserted therein.

8. The bat of claim 1, wherein said axial hole of said wood body includes a rear section having a first diameter, a front section having a second diameter that is larger than the first diameter of said rear part, and said tubular core is inserted in the inside of said rear section.

9. The bat of claim 1, wherein said axial hole is disposed from said handle and extending into said tapered portion but terminating short of said barrel.

10. The bat of claim 9, further comprising at least one shock-absorbing member respectively inserted inside said tubular core.

11. The bat of claim 9, further comprising at least one weight respectively inserted inside said tubular core.

* * * * *